US006751955B1

(12) United States Patent
Houtman

(10) Patent No.: US 6,751,955 B1
(45) Date of Patent: Jun. 22, 2004

(54) STIRLING ENGINE WITH SWASHPLATE ACTUATOR

(75) Inventor: William H. Houtman, Ann Arbor, MI (US)

(73) Assignee: STM Power, Inc., Ann Arbor, MI (US)

( * ) Notice: Subject to any disclaimer, the term of this patent is extended or adjusted under 35 U.S.C. 154(b) by 0 days.

(21) Appl. No.: 10/393,052

(22) Filed: Mar. 20, 2003

(51) Int. Cl.[7] ..... F01B 29/10
(52) U.S. Cl. ..... 60/517; 60/524; 92/153
(58) Field of Search ..... 60/517, 524; 92/12.2, 92/57, 71, 153

(56) References Cited

U.S. PATENT DOCUMENTS

| | | | | |
|---|---|---|---|---|
| 3,418,992 A | * | 12/1968 | Anderson et al. | 123/182.1 |
| 4,016,720 A | | 4/1977 | Meijer | |
| 4,019,322 A | | 4/1977 | Meijer | |
| 4,030,404 A | | 6/1977 | Meijer | |
| 4,090,430 A | * | 5/1978 | Matsumoto et al. | 92/71 |
| 4,145,887 A | | 3/1979 | Meijer | |
| 4,258,590 A | | 3/1981 | Meijer et al. | |
| 4,372,116 A | | 2/1983 | Dineen | |
| 4,454,779 A | | 6/1984 | Vos | |
| 4,532,855 A | | 8/1985 | Meijer et al. | |
| 4,579,046 A | | 4/1986 | Meijer et al. | |
| 4,615,261 A | | 10/1986 | Meijer | |
| 4,885,980 A | * | 12/1989 | Meijer et al. | 92/12.2 |
| 4,966,841 A | | 10/1990 | Riley | |
| 4,994,004 A | | 2/1991 | Meijer et al. | |
| 4,996,841 A | | 3/1991 | Meijer et al. | |
| 5,074,114 A | | 12/1991 | Meijer et al. | |
| 5,611,201 A | | 3/1997 | Houtman | |
| 5,836,846 A | | 11/1998 | Hewko et al. | |
| 5,979,294 A | | 11/1999 | Hugelman | |
| 6,431,841 B2 | * | 8/2002 | Tarutani et al. | 417/269 |

OTHER PUBLICATIONS

RV–Series Rotary Vane Valve Actuators (Shafer Valve Operating Systems).
New Adjustable Stroke Control Module for Axial Hydraulic Pumps—Rodney D. Hugelman, PHD, PE—WhiteMoss, Inc., 603 Duncan Rd., Champaign, IL 61821—Revised Jul. 15, 1996.
Micro–Precision Textron HS Models—High Pressure 3000 PSI Hollow Shaft Rotary Actuators.
Micro–Precision Textron Rotary Actuators "Engineering Data".

* cited by examiner

*Primary Examiner*—Hoang Nguyen
(74) *Attorney, Agent, or Firm*—Brinks Hofer Gilson & Lione

(57) ABSTRACT

A hydraulic actuator for a multicylinder Stirling engine provided to enable modulation of the displacement of the engine. The hydraulic actuator incorporates a rotary vane configuration which provides relative rotational adjustment between components of a swashplate assembly. The relative rotation provides adjustments to the angle formed by the swashplate relative to its angle of rotation, and thus varies the stroke of each piston connecting rod, which thereby modulates the swept volume of the respective piston within its cylinder bore.

8 Claims, 4 Drawing Sheets

STIRLING ENGINE WITH SWASHPLATE ACTUATOR

BACKGROUND OF THE INVENTION

This invention is related to a heat engine and particularly to an improved Stirling cycle engine incorporating a mechanism for modulating the displacement of the engine.

In order that a Stirling engine meet the output requirements demanded for a particular operating condition, some means of power modulation is required. One approach is through adjusting the swept volume or displacement of the reciprocating pistons of the machine. The Assignees of the present invention have developed numerous approaches toward providing such modulation adjustment. In the Stirling engine of the type described in this specification, modulation adjustment is achieved by changing the angle which the swashplate forms from its axis of rotation. As the swashplate face surfaces approach a plane perpendicular to its axis of rotation, the swept volume of the pistons decrease. Conversely, when the swashplate face surfaces are inclined from a plane perpendicular to its rotational axis, the swept volume of the pistons increase.

The Assignees of the present application have incorporated various mechanical, electrical and hydraulic systems for causing the swashplate angle to be varied in a desired manner. One series of devices provides hydraulically actuated swashplate adjustment as described by U.S. Pat. No. 4,532,855. Various electrically driven actuators have also been described by the Assignee, including those described in U.S. Pat. Nos. 4,994,004; 5,611,201; and 5,836,846. Although the devices described by those previously referenced patents are viable designs, there is a continuing need to provide such adjustment systems which have the features of simplicity, rapid transient response, and reliability. This invention is aimed at achieving those desirable features. This invention further addresses the need to provide a measure of swashplate angle, needed as part of a variable swashplate control system.

SUMMARY OF THE INVENTION

In accordance with the present invention, a swashplate actuator system is described incorporating a hydraulic actuation system. The mechanism uses hydraulic pressure to move a rotary vane for providing swashplate angle adjustments.

The present invention further provides two approaches toward measuring swashplate angle, each using one or more proximity probes interacting with portions of the rotating driveshaft or the reciprocating motion of the cross heads of the engine.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
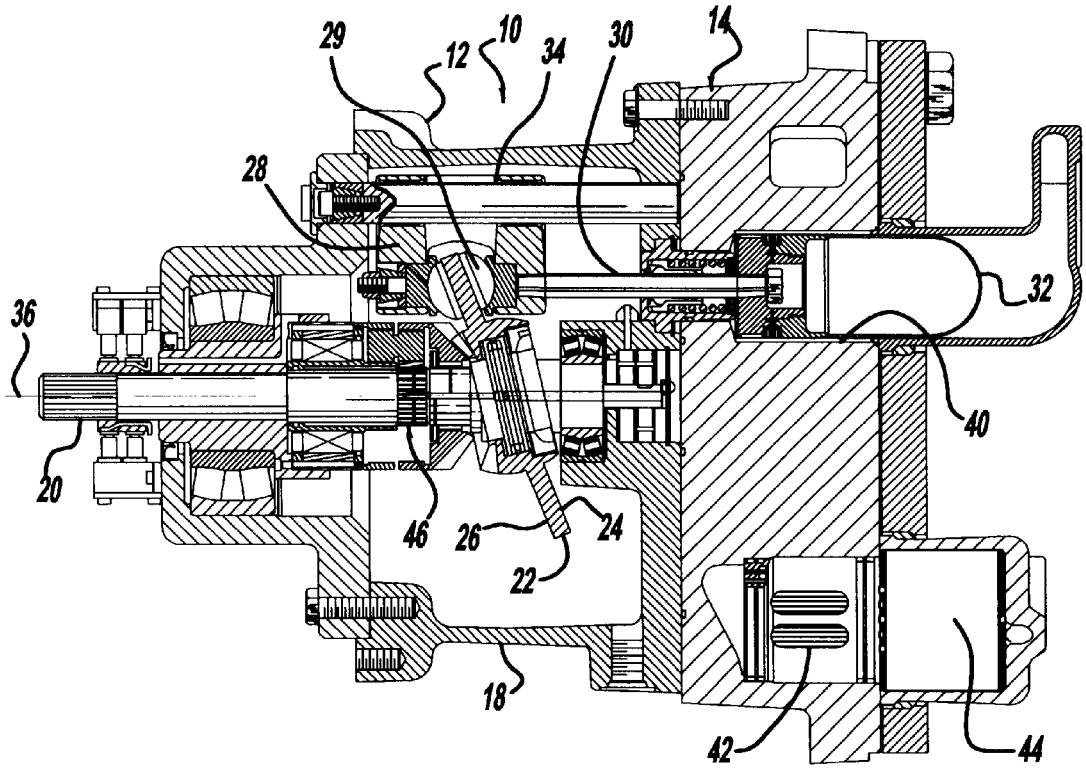
FIG - 1 Prior Art
FIG. 1 is a representative longitudinal cross sectional view of a Stirling engine of a prior art type suited for incorporation of the present invention.

A Stirling engine of a type suited for use with the present invention is shown in assembled condition in FIG. 1 and is generally designated by reference number 10. Stirling engine 10 incorporates a number of primary components, including drive case assembly 12, cylinder block assembly 14, and heater assembly (not shown).

Drive case assembly 12 incorporates housing 18 with drive shaft 20 journaled for rotation within the housing. Swashplate 22, which will be described in greater detail below, provides a pair of opposed generally parallel face surfaces 24 and 26. Each face surface 24 and 26 will preferably be provided with a slight taper in the radial direction in the order of 0.6°, to thereby facilitate establishing a hydrodynamic film between the surfaces 24, 26 and the respective adjacent cross head bearings 29. Cross heads 28 engage the opposed face surfaces 24 and 26 and are connected with connecting rods 30 which are in turn coupled with pistons 32. Cross heads 28 are maintained to reciprocate along an axis through the use of guide rods 34. Through this mechanical linkage, reciprocating motion of pistons 32 are translated into rotation of drive shaft 20. As is also evident, the angle which swashplate face surfaces 24 and 26 form with respect to the longitudinal axis of rotation 36 of drive shaft 20 (the plane of the swashplate) defines the stroke or displacement distance for the pistons 32.

Figure 2:
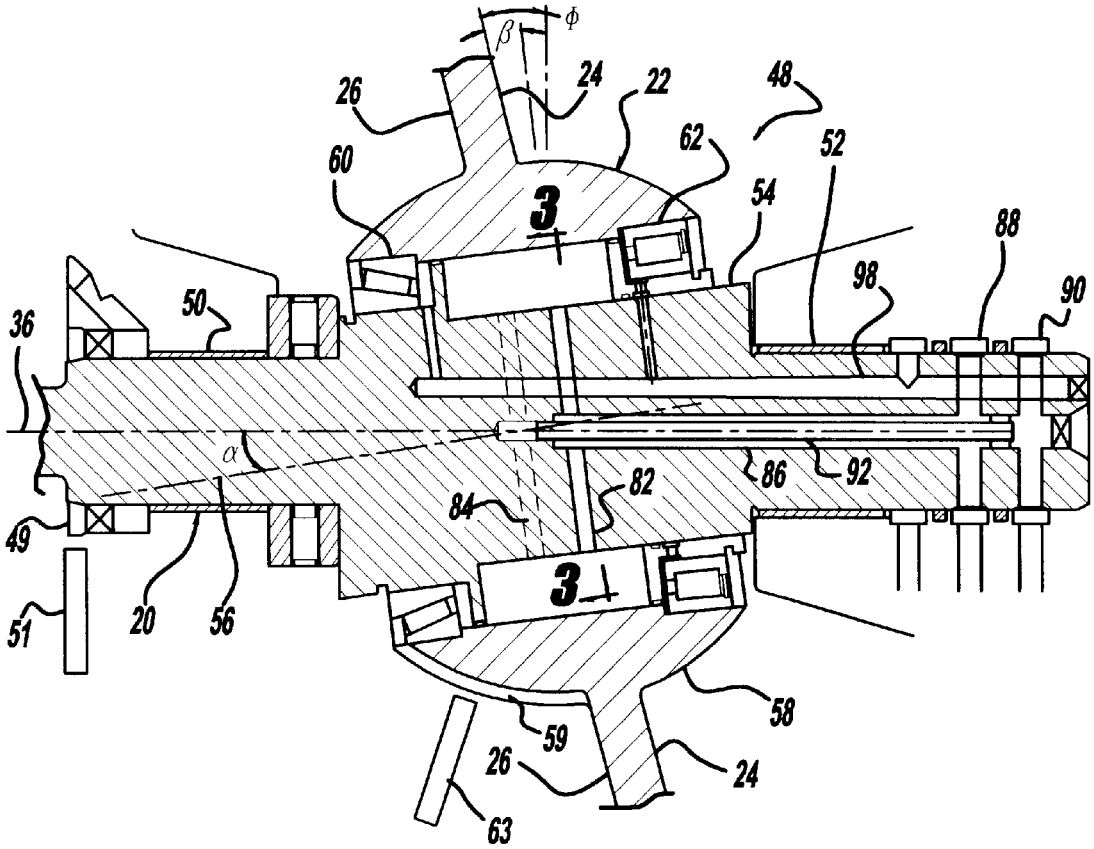
FIG. 2 is a longitudinal cross sectional view through the hydraulic swashplate actuator in accordance with this invention.
Figure 3:
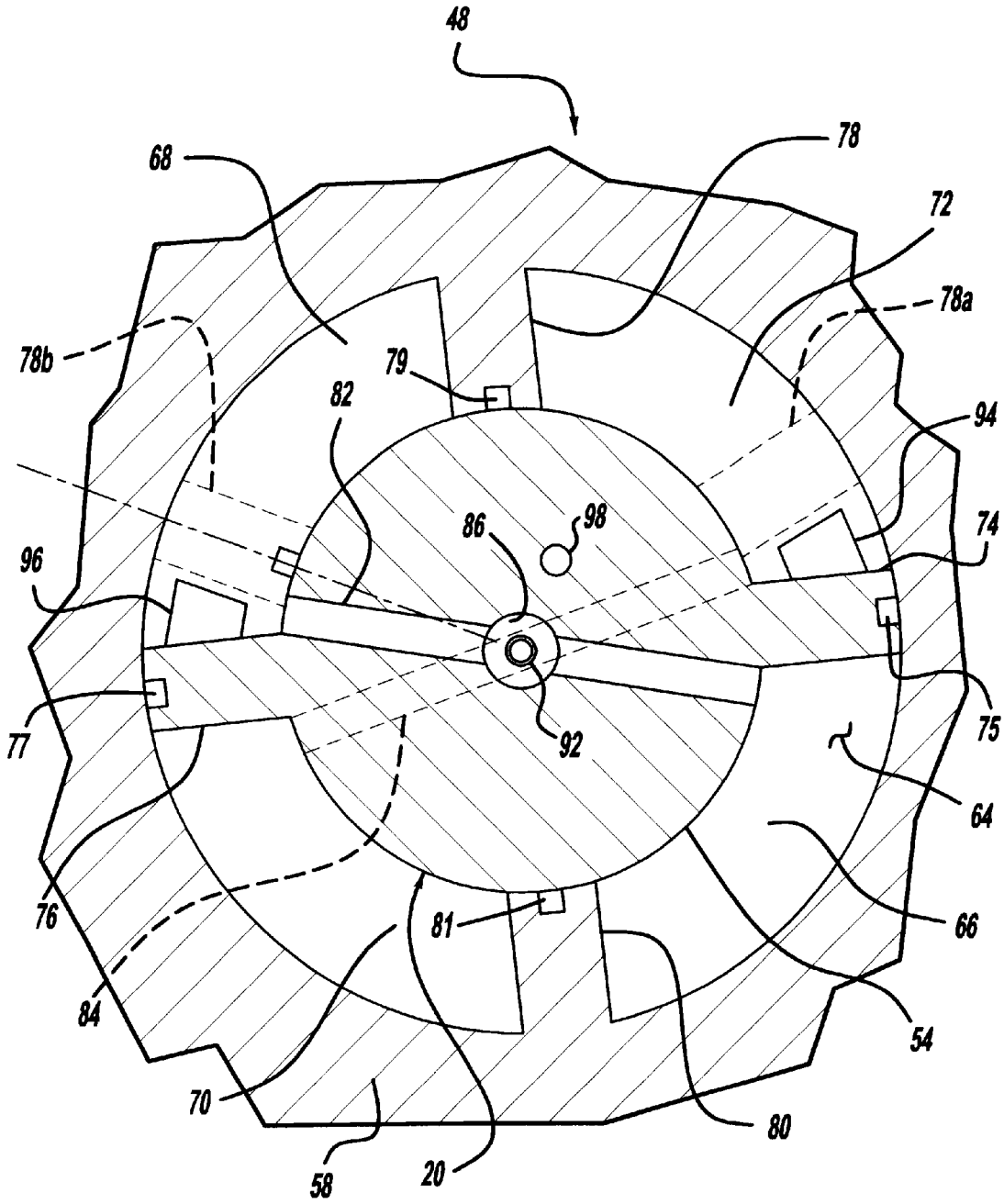
FIG. 3 is a cross sectional view taken from FIG. 2 showing the internal pressure cavities of the rotary vane actuator.

Cylinder block assembly 14 incorporates a number of cylinder bores 40 through which pistons 32 reciprocate. In the well known Stirling thermodynamic cycle, the pistons 32 shuttle a working gas such as helium or hydrogen between a cold space and a hot space. In this instance, the volume of gas above the dome of pistons 32 and the heater assembly (not shown) constitute the hot space of the engine. The cold space is defined, in part, by gas cooler 42. Regenerator 44 is placed between gas cooler 42 and the heater assembly. The Stirling engine 10 illustrated in this description is a multi-cylinder, double acting type. In this instance, there is a gas volume connection between the hot space of one piston 32 and the cold space of the adjacent cylinder and piston. Engine 10 of FIG. 1 incorporated a swashplate actuator 46 of the electrically actuated type. FIGS. 2 and 3 illustrate swashplate actuator 48 of this invention which replaces actuator 46.

Additional details regarding the construction of Stirling engine 10 may be provided with reference to U.S. Pat. No. 5,611,201 which is incorporated herein by reference.

Now with specific reference to FIG. 2, the components of swashplate actuator 48 are shown in more detail. Drive shaft 20 rotates within suitable journal bearing which include bearing shells 50 and 52. These journal bearings are supplied with lubricating oil in a conventional manner. Drive shaft 20 incorporates swashplate journal 54 which is a cylindrical surface having its central longitudinal axis 56 inclined at angle a with respect to drive shaft axis 36. Swashplate ring 58 is rotatably mounted on swashplate journal 54 via a pair of rolling element bearing assemblies 60 and 62. The swashplate face surfaces 24 and 26 define parallel planes which are displaced from a plane perpendicular to journal axis 56 by angle $\beta$ as shown in FIG. 2. In this manner, relative rotation between swashplate journal 54 and swashplate ring 58 cause the angle of the plane formed by face surfaces 24 and 26 to vary with respect to the longitudinal axis 36 of the drive shaft, shown as angle $\phi$. The relative rotated positions of swashplate ring 58 and swashplate journal 54 determine the extent to which angles $\alpha$ and $\beta$ add to increase the swashplate angle $\phi$, or subtract to reduce angle $\phi$. As shown in FIG. 2, angle $\phi$ is at its maximum, in which angles $\alpha$ and $\beta$ add at their full values to maximize angle $\phi$. It is preferred that angles $\alpha$ and $\beta$ are equal to one another.

As one means of measuring the angular position of swashplate face surfaces 24 and 26 and therefore the displacement of swashplate actuator 48, a pair of electrical signal outputs are provided from proximity probes. As shown in FIG. 2, an extending shoulder of driveshaft 20 forms a projecting tab 49. Tab 49 interacts with an electrical induction proximity probe 51. Each time tab 49 rotates past proximity probe 51, an electrical output signal is provided. In a similar manner, swashplate ring 58 forms protruding arcuate shaped tab 59. Tab 59 interacts with electrical induction proximity probe 63 and provides an electrical output signal each time tab 59 passes across proximity probe 63. Tab 59 has an arcuate shape since it needs to interact with probe 63 over a range of angular positions. Since the relative angular position between drive shaft 20 and swashplate ring 58 is directly related to the swashplate angle $\phi$, the phase difference in the outputs between proximity probes 51 and 63 may be used to provide such an indication. Through the use of a suitable control system, the phase difference between the outputs from proximity probes 51 and 63 allow the swashplate angle to be continuously monitored. This output is used by a suitable control system to control the swashplate actuator 48 to provide a desired displacement for engine 10. An alternative technique for instantaneously computing displacement is that of measuring linear displacement of any two cross heads 28 that are 90° from one another with an appropriately located proximity probe or sensor 51 for each cross head and equating displacement or swashplate angle, or both as desired.

As best shown in FIG. 3, drive shaft 20 and swashplate ring 58 cooperate to define a divided generally annular hydraulic cavity 64. This cavity 64 is divided into four discrete isolated chambers 66, 68, 70 and 72. In part, these chambers are isolated by a pair of diametrically arranged radially outwardly extending vanes 74 and 76 which extend from swashplate journal 54. Another pair of radially oriented vanes 78 and 80 extend in a radially inward direction from swashplate ring 58. Fluid sealing access across vanes 74, 76, 78, and 80 is provided by tip seals 75, 77, 79, and 81, respectively.

Chambers 66, 68, 70 and 72 operate as opposed pairs. Hydraulic fluid is supplied to the coupled pair of chambers 66 and 68 via supply passage 82, and chambers 70 and 72 via oil supply passage 84. As best shown in FIGS. 2 and 3, a central oil passageway 86 is supplied by separate ports 88 and 90 which communicate with the outside diameter of driveshaft 20. A central tube 92 divides oil passageway 86 into two discrete passages. Oil flowing into port 88 flows around the outside of tube 92 and through passage 82. Conversely, oil supplied to port 90 travels through the interior of tube 92 and flows into passage 84. Passageway 98 is provided to provide lubricating oil to bearings 60 and 62.

The positions of passages 82 and 84 are best shown with reference to FIG. 3. Passageway 82 extends diametrically across the drive shaft 20 and opens into cavities 66 and 68 at a position just adjacent to vanes 74 and 76. Passageway 84 also extends diametrically across drive shaft 20 and communicates with chambers 70 and 72 at positions also just adjacent to vanes 74 and 76, but on the opposite sides of the vanes as passageway 82.

By controlling the pressure of applied hydraulic fluid in passages 82 and 84, the angle of swashplate ring 58 with respect to drive shaft 20 and therefore the stroke of the engine can be modulated. FIG. 3 illustrates a condition in which the volume of fluid is supplied through passage 82 as compared with passage 84 is roughly equal, causing the volumes of chambers 66 and 68 to be nearly the same as that of chambers 70 and 72. This condition corresponds with an engine displacement between the minimum and maximum volumes by controlling the stroke. When hydraulic fluid is supplied at greater pressure to passageway 82, hydraulic fluid fills chambers 66 and 68 and they expand. This causes the swashplate ring 58 to rotate relative to the drive shaft 20 in a clockwise direction, until vane 78 reaches the phantom line position illustrated in FIG. 3 designated by reference number 78*a* (vane 80 undergoes the same angular change in position). At that position of vane 78*a*, stop block 94 is contacted and continued relative rotation is not permitted. This position represents an extreme position of either maximum of minimum swashplate angle and corresponding piston 32 stroke.

When it is desired to rotate swashplate actuator 48 to the opposite extreme position, hydraulic fluid is sent through passageway 84. In that condition, chambers 70 and 72 expand as fluid from chambers 66 and 68 is drained. This causes swashplate journal 54 to rotate in a counterclockwise direction relative to drive shaft 20, eventually reaching the position shown in FIG. 3 where vane 78 reaches the position designated by reference number 78*b*, at which point stop block 96 is contacted. While the intermediate and extreme positions were previously described, it is possible to place the components in any desired relative angular position between the extremes through appropriate control of applied pressures.

Figure 4:
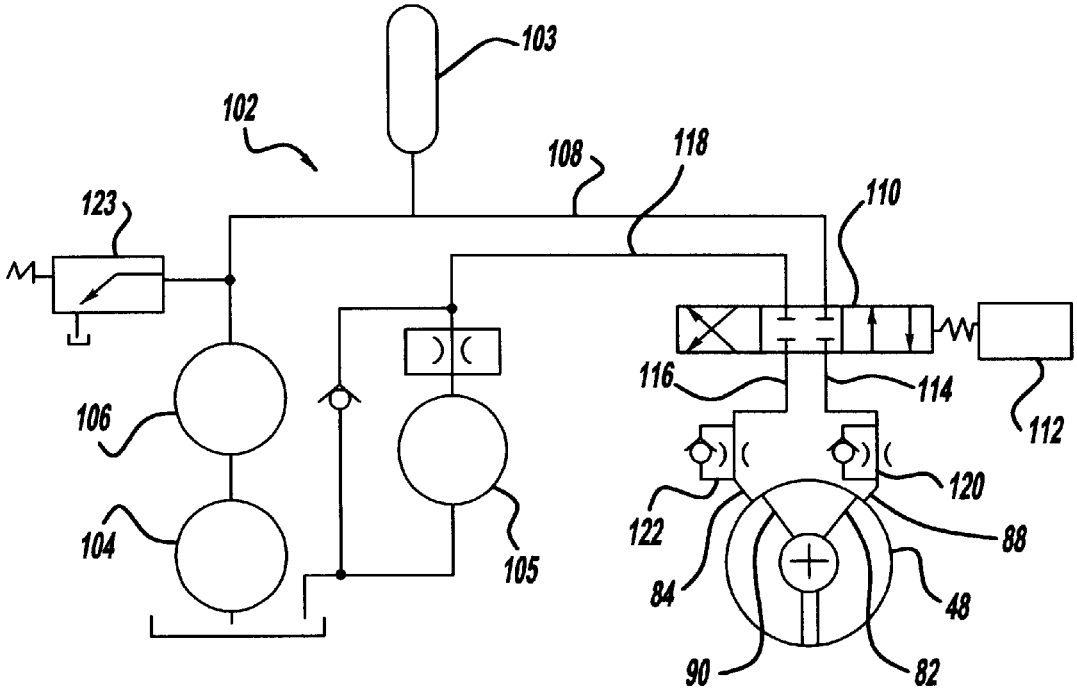
FIG. 4 is a diagrammatic view of a hydraulic actuator circuit for controlling the swashplate actuator of this invention in accordance with a first embodiment.

Now with reference to FIG. 4, a hydraulic actuator circuit is shown which supply hydraulic fluid to swashplate actuator 48 enabling it to undergo its change in position as described previously. FIG. 4 illustrates hydraulic actuator circuit 102. As shown in FIG. 4, hydraulic fluid is stored in reservoir 104 and its pressure is increased through the use of pump 106. Accumulator 103 provides a storage volume maintained at pressure. High pressure fluid is supplied on line 108 to a port of four-way directional control valve 110. Solenoid 112 controls the position of a spool of directional control valve 110 to provide the fluid port connections 88 and 90 diagrammatically illustrated in FIG. 4. In one position of the spool, line 108 becomes connected with line 114 which connects with port 88 and passageway 82. Another line 116 is connected with passageway 84 via port 90. Return line 118 allows hydraulic fluid to return back to reservoir 104. Pressure control valves 120 and 122 are plumbed into lines 114 and 116, respectively to control the outflow of hydraulic fluid into return line 118. Pressure relief valve 123 drains fluid to reservoir 104 in the event of an overpressure condition. Filter 105 is provided to remove contaminants from the hydraulic fluid.

In operation of hydraulic actuator circuit 102, when it is desired to change the swashplate angle, a control signal is directed to directional control valve solenoid 112. By shifting the spool between the positions illustrated diagrammatically in the left and right hand sections of valve 110, lines 114 and 116 are selectively connected with supply line 108 and return line 118 pressurized or provide a return fluid path as desired. Since there will generally be a slow leak of hydraulic fluid across actuator vanes 76 and 78, there will be continuous need to actuate valve 110 as the actuator position deviates from a desired set position.

While the above description constitutes the preferred embodiment of the present invention, it will be appreciated that the invention is susceptible to modification, variation and change without departing from the proper scope and fair meaning of the accompanying claims.

What is claimed is:

1. A swashplate actuator for a Stirling engine of the type having a swashplate rotatable with a driveshaft which rotates about an axis of rotation, a plurality of reciprocating pistons which engage the swashplate though cross heads, and wherein the reciprocating stroke of the pistons is variable as a function of the angle formed by the plane of the swashplate to the axis of rotation, the actuator comprising:

a driveshaft rotatable about the axis of rotation and having a cylindrical swashplate journal forming a central journal axis inclined from the axis of rotation;

a swashplate ring journaled for rotation about the journal axis, the swashplate ring forming a disk which defines the swashplate plane which is inclined from normal to the journal axis and which engages the cross heads, the driveshaft and the swashplate ring cooperating to form an annular hydraulic cavity;

a pair of driveshaft vanes diametrically opposed to one another and extending radially outwardly into the hydraulic cavity;

a pair of swashplate ring vanes diametrically opposed and extending radially inwardly into the hydraulic cavity, the pairs of vanes dividing the hydraulic cavity into four separated chambers; and fluid supply passageway in the driveshaft including a first passageway supplying fluid to a first pair of the chambers which are diametrically opposed, and a second passageway supplying fluid to a second pair of the chambers which are diametrically opposed, wherein the fluid may be supplied though the first or second passageway to enlarge the first or second pairs of chambers respectively which causes the swashplate ring to rotate relative to the driveshaft journal causing the swashplate plane angle to change.

2. A swashplate actuator for a Stirling engine according to claim 1 further comprising a first and a second supply port for respectively providing hydraulic oil to the first and second passageways, the supply ports communicating with the outside diameter of the driveshaft.

3. A swashplate actuator for a Stirling engine according to claim 1 further comprising a stop block positioned between at least one swashplate ring vane and at least one driveshaft vane for defining a physical stop in the range of relative rotation between the swashplate ring and the driveshaft.

4. A swashplate actuator for a Stirling engine according to claim 1 wherein the engine produces mechanical output power through the pistons engaging the swashplate to urge the swashplate and the driveshaft to rotate.

5. A swashplate actuator for a Stirling engine according to claim 1 wherein the engine is a double-acting type.

6. A swashplate actuator for a Stirling engine according to claim 1 wherein the first and the second passageways are defined by a bore in the driveshaft having a tube installed therein, the tube dividing the bore into the first and the second passageways defined by separating the fluid flowing inside the tube or outside the tube.

7. A swashplate actuator for a Stirling engine according to claim 1 further comprising a hydraulic circuit for supplying the fluid to the first and second passageways including a directional control valve which supplies the fluid under pressure to one of the first or second passageways and allows the fluid in the other of the first or second passageway to be drained thereby causing the swashplate ring to rotate relative to the driveshaft journal.

8. A swashplate actuator for a Stirling engine according to claim 1 further comprising a first proximity probe interacting with the driveshaft for providing an output as a function of the rotated position of the driveshaft and a second proximity probe interacting with the swashplate ring wherein the phase difference in the outputs of the first and second proximity probes provide an indication of the swashplate plane angle.

* * * * *